United States Patent [19]

Mutschler

[11] 4,438,787

[45] Mar. 27, 1984

[54] DEVICE FOR SELECTING THE HOOKS OF A WEAVING MECHANISM BY SUCCESSIVELY FEELING THE TWO HALVES OF A CARD OF THE JACQUARD TYPE

[76] Inventor: Ulrich Mutschler, 41A rue Pasteur, 69300 Caluire, France

[21] Appl. No.: 360,733

[22] Filed: Mar. 22, 1982

[30] Foreign Application Priority Data

Apr. 14, 1981 [FR] France ..... 81 07650

[51] Int. Cl.[3] ..... D03C 3/34; D03C 15/04

[52] U.S. Cl. ..... 139/329; 139/335

[58] Field of Search ..... 139/329, 328, 333, 335, 139/332

[56] References Cited

FOREIGN PATENT DOCUMENTS

| | | | |
|---|---|---|---|
| 516529 | 1/1931 | Fed. Rep. of Germany | 139/329 |
| 1218681 | 12/1959 | France | 139/329 |
| 264156 | 4/1929 | Italy | 139/329 |
| 47-34675 | 8/1972 | Japan | 139/333 |
| 47-35339 | 9/1972 | Japan | 139/335 |
| 48-27622 | 8/1973 | Japan | 139/335 |
| 209315 | 1/1968 | U.S.S.R. | 139/329 |

*Primary Examiner*—James Kee Chi

*Attorney, Agent, or Firm*—Dowell & Dowell

[57] ABSTRACT

The present invention relates to a device for selecting the hooks of a weaving mechanism by successive feeling of two half zones of a card of the Jacquard type. Said device comprises a Maltese cross having four inlets determined by two perpendicular grooves and a driver of which the two pins are located at two different radial distances from the center. In this way, the Maltese cross is subjected to two alternating angular rotations of different amplitude. The invention is particularly applicable to weaving mechanisms incremental.

4 Claims, 7 Drawing Figures

DEVICE FOR SELECTING THE HOOKS OF A WEAVING MECHANISM BY SUCCESSIVELY FEELING THE TWO HALVES OF A CARD OF THE JACQUARD TYPE

The present invention relates to a device for selecting the hooks of a weaving mechanism by successive feeling of the two halves of a card of the Jacquared type.

It is known that, in a weaving mechanism, the selection of the hooks is effected with, as information support, cards or paper previously perforated on punching machines.

When a weaving mechanism is intended to cooperate with a loom of which the warp yarns are of reduced number, or for other reasons, one can be content with a mechanism comprising only eight rows of hooks instead of sixteen in the longitudinal direction.

The conventional punching machines are arranged to perforate the paper along zones comprising fifty six rows of eight holes, which zones are separated by a non-perforated space.

It will be readily understood that, when a mechanism with eight rows of hooks is used, there is a corresponding number of feeler needles adapted to feel the paper, with the result that the mechanism must comprise means for making the feeler needles operate twice in each zone. It is therefore necessary to use specially arranged punching machines on which the paper is moved in two different strokes, the first corresponding to half the height of each zone, whilst the other must be equal to said half-height increased by the space included between two zones. As work with a mechanism with eight hooks is relatively rare, it would appear abnormal to create a special punching machine. It was then thought to use only half of the holes of each zone so that operation is carried out card by card on the weaving mechanism, in conventional manner. However, such a modus operandi involves, of course, a considerable waste of paper since twice the quantity of paper needed is used.

It is an object of the improvements according to the present invention to produce a weaving mechanism provided with a paper feeling device capable of successively reading the perforations of two half zones of the same card.

The invention will be more readily understood on reading the following description with reference to the accompanying drawings, in which.

Figure 1:
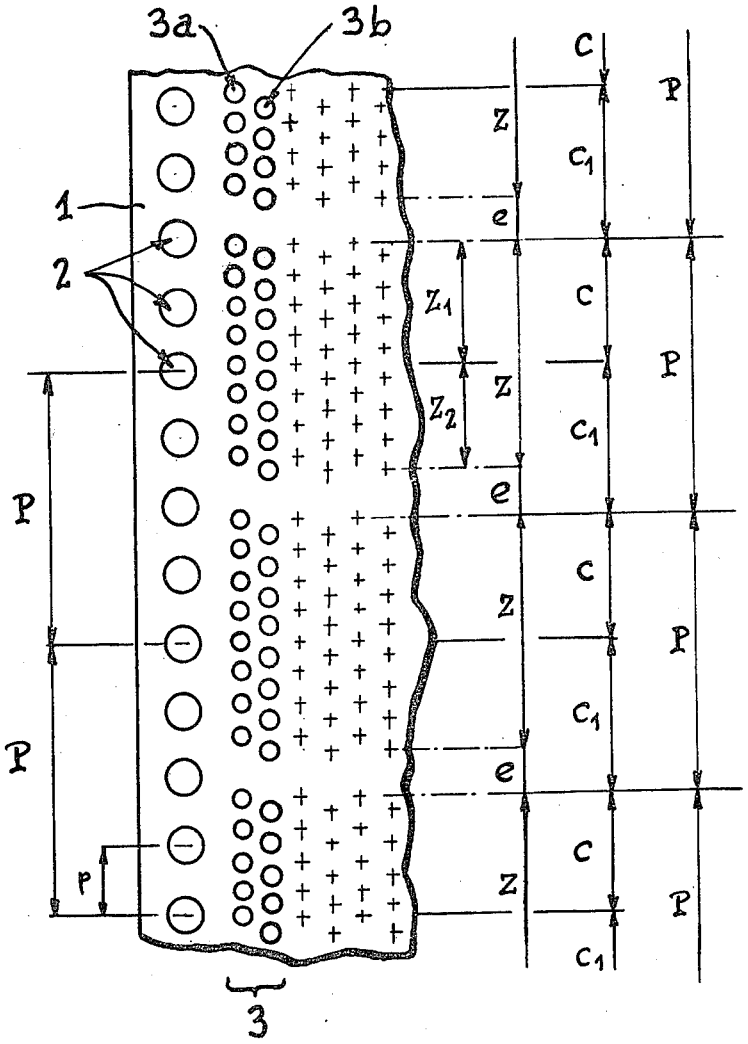
FIG. 1 is a partial view of a perforated Verdol paper used on a conventional weaving mechanism.

Referring now to the drawings, FIG. 1 shows the left side of a Verdol paper, generally referenced 1, of which each of the edges comprises a series of longitudinal perforations 2 adapted to receive radial claws borne by a rotating drum ensuring drive of the paper. The latter is intended to be perforated in successive zones Z of determined width, which are separated by a non-perforated transverse space referenced e.

When the paper is standard, the holes are arranged in rows 3 each comprising two lines 3*a*, 3*b* of eight holes in the direction of advance of the paper, whilst, in the transverse direction, there are twenty eight rows, which gives a total of four hundred and forty eight possibilities of perforations. The Figure shows one row 3 comprising two lines 3*a*, 3*b* of eight holes, offset longitudinally. The spacing of the holes is such that the distance between the geometric axes from the first hole of row 3*a* to the last hole of row 3*b* corresponds to distance Z mentioned above.

It will be recalled that each hole of a zone Z is allocated to a reading element or feeler needle which abuts on the paper if there is no hole or, on the contrary, passes therethrough with a view to actuating a needle which is in relation with a hook. This arrangement will not be described in greater detail as it is well known in the art.

In a standard mechanism, each zone is felt once only, the information collected corresponding to the selection of the hooks for the passage of a pick. This zone is also called "card". When a mechanism is used having eight rows of hooks, it is according to this invention to read two successive selections on the same card, as has been explained hereinabove, with a view to economising paper and also to increasing the speed.

Under these conditions, zone Z is divided into two transverse bands of the same width, each comprising a succession of two rows 3 of four holes. Each of these bands has been referenced Z1 and Z2 in the Figure. At the moment of reading, the arrangement in question raises problems as the displacement necessary for displacing successive ones of the perforated bands under the reading device is not of constant value. In fact, it is observed that, to pass from one band to another, the paper must firstly be displaced by a stroke C corresponding to the width of the band Z1 in order to allow the perforations of band Z2 to be read, then, with a view to bringing the band Z1 under the reading device, the paper must be advanced by larger stroke C1 such that $C1=Z2+e$.

It will be noted that the sum P of the strokes C and C1 is equal to four times the pitch p of the perforations 2 for driving the paper.

It is therefore necessary alternately to advance the paper in discontinuous manner with two different strokes, which is not the case in conventional mechanisms whose advances are regular.

The control device according to the present invention comprises, as illustrated in FIGS. 2 to 7, a Maltese cross 4 fixed on the shaft of the paper drive drum and a simple, continuously rotating driver 5. The Maltese cross 4 comprises two perpendicular grooves 4*a*, 4*b* constituting four notches distributed regularly on its periphery, whilst the driver 5 is provided with two pins 5*a*, 5*b* of which the distances to the centre of the driver are different. Thus, the radial distance d separating the pin 5*a* from the centre of the driver is greater than that, d1, separating the pin 5*b* from said centre.

The driver 5 is fixed on a shaft (not shown) suitably driven to communicate to the Maltese cross the desired angular displacements.

At the beginning of the movement, the pin 5*a* is located at the entrance of the groove 4*b* which is oriented so as to determine with the horizontal an angle greater than 45° by a increment. The driver 5 provokes, on rotating, the rotation of the Maltese cross 4, the pin 5*a* making, in conventional manner, a to-and-fro movement within the corresponding part of the groove 4*b*, FIGS. 3 and 4. It leaves the latter when the Maltese cross 4 has made a rotation in the direction opposite that of the driver 5, i.e. in clockwise direction, through an angle greater than 45° by the increment $\alpha$. Under these conditions, the total rotation of the Maltese cross 4 is $90°+2\alpha$.

Figure 5:
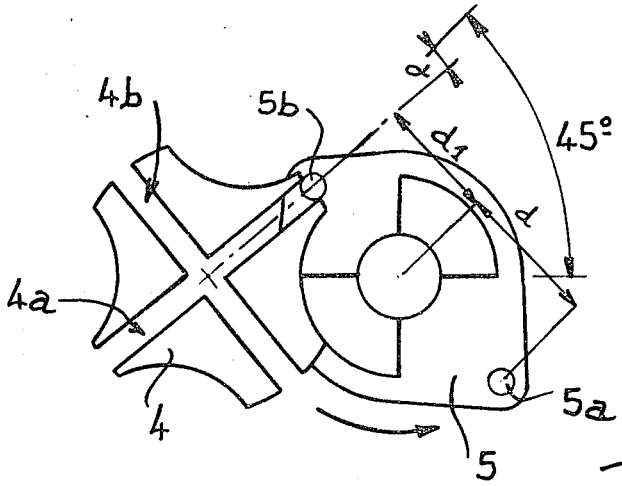
Figure 6:
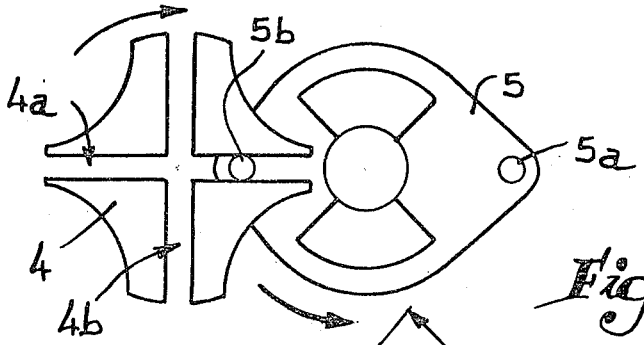
Figure 7:
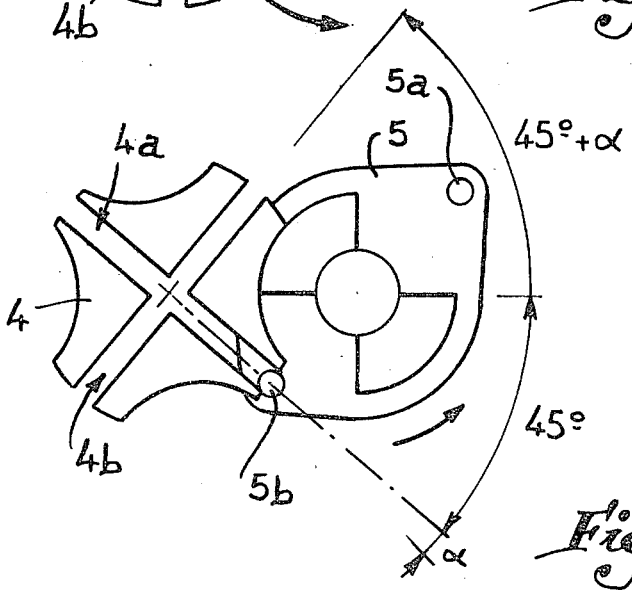

The opening of the groove 4*a* of the Maltese cross is then oriented with respect to the horizontal at an angle of $45°-\alpha$(FIG. 5). It is at this orientation that pin 5*b* penetrates into said groove 4*a* to rotate the Maltese cross 4. There again, the pin 5*b* makes a to-and-fro movement in the groove in question, FIGS. 6 and 7, to leave said latter (FIG. 7) when it is oriented at an angle of $45°-\alpha$ below the horizontal. Under these conditions, the Maltese cross 4 has described an angle of $90°-2\alpha$.

Figure 2:
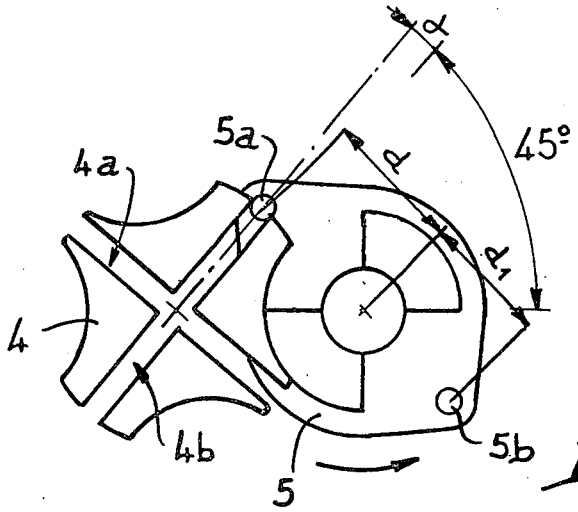
FIGS. 2 to 7 illustrate the different operational phases of a mechanism for advancing the paper according to the invention. The first three Figures correspond to the greatest rotation of the paper-bearing drum, whilst the other three Figures refer to the smallest advance stroke.
Figure 3:
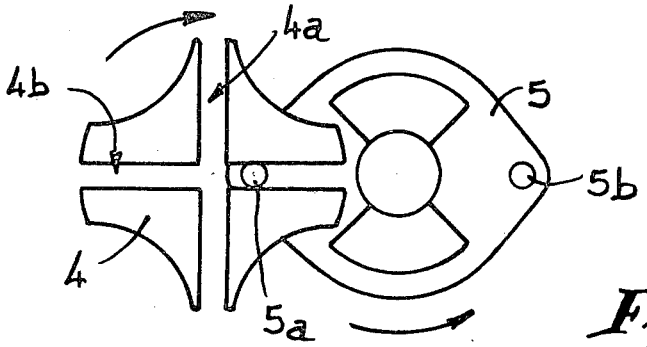
Figure 4:
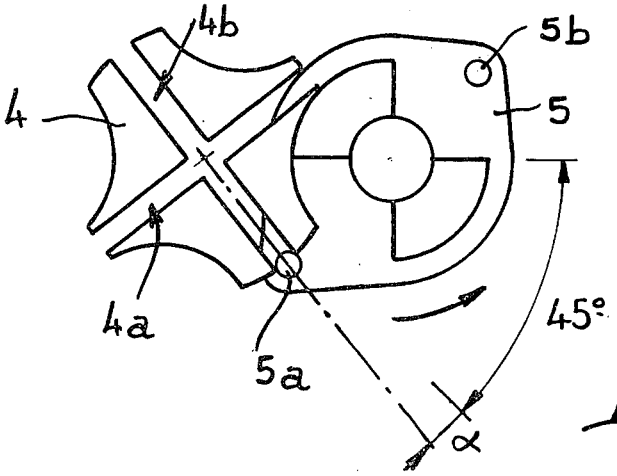

The groove 4*b* is then oriented obliquely along an angle of $45°+\alpha$ above the horizontal, so that the pin 5*a* will penetrate therein as illustrated in FIG. 2. The Maltese cross therefore rotates intermittently through two different successive angular strokes. Of course, the stopping time of the Maltese cross corresponds to the time necessary for reading the perforations of each zone.

A particularly well adapted embodiment comprises a Maltese cross having four notches, driving, through a set of pinions having a reduction ratio of 9/1, the shaft bearing the paper driving drum. In this way, eighteen advances are obtained for one revolution of the shaft which bears the paper advance drum. With this arrangement, the mean immobilisation times for feeling and displacing the paper are, expressed in degrees of rotation of the weaving loom, about 200° and 160°.

The preceding description has of course only been given by way of non-limiting example and modifications may be made to the invention without departing from the scope thereof.

What is claimed is:

1. An improved mechanism for intermittently advancing an endless Jacquard paper on a drum to pass beneath feeler needles controlling a loom and biased to read perforation patterns in the paper by passing through the perforations, the paper being divided longitudinally into transverse extending successive zones each constituting a standard perforated pattern card zone separated from adjacent card zones by non-perforated transverse zones, the improved mechanism being cooperative with a modified loom wherein the number of feeler needles is reduced to one half the number of needles for which the standard perforation pattern is designed and wherein the pattern of each card is advanced in two successive strokes and read in two successive half-zones by the reduced number of feeler needles, the advancing mechanism for driving the drum comprising:

(a) first means connected to be driven continuously in synchronism with the loom; and (b) second means coupled to drive the drum and to be driven by said first means to rotate intermittently and alternately through two different angular motions respectively displacing the paper through two different successive strokes to bring the feeler needles into registry with the two half zones of each card.

2. The advancing mechanism as claimed in claim 1, wherein said different angular motions rotate the drum to move the paper alternately through shorter and longer strokes, the shorter stroke equaling the longitudinal extent of one half-zone, and the longer stroke equaling the longitudinal extent of one half-zone plus the longitudinal extent of a non-perforated zone.

3. The advancing mechanism as claimed in claim 1, wherein the first means comprises a driver member rotated about its axis synchronously with the loom and having two diametrically opposite pins respectively located at smaller and greater radial distances from its axis, and wherein said second means comprises a Maltese cross having multiple annularly spaced radial notches located adjacent to the driver member and disposed so that alternate pins engage successive ones of said notches to cause the second member to rotate with alternately different angular motions.

4. The advancing mechanism as claimed in claim 3, wherein the Maltese cross has four radial notches, and the mechanism further including coupling means between the drum and the second means comprising gearing having a reduction ratio of 9:1, one revolution of the drum advancing the paper through 18 strokes.

* * * * *